US007222505B2

(12) United States Patent
Ronchi

(10) Patent No.: US 7,222,505 B2
(45) **Date of Patent: *May 29, 2007**

(54) DYING OR BLEACHING APPARATUS FOR YARN WOUND ON REELS OR SIMILAR PACKAGES

(75) Inventor: Francesco Ronchi, Sovico-Milan (IT)

(73) Assignee: Master S.a.S Di Ronchi Francesco & C., Macherio-Milan (IT)

( * ) Notice: Subject to any disclaimer, the term of this patent is extended or adjusted under 35 U.S.C. 154(b) by 262 days.

This patent is subject to a terminal disclaimer.

(21) Appl. No.: 10/476,688

(22) PCT Filed: May 23, 2002

(86) PCT No.: PCT/EP02/05755

§ 371 (c)(1),
(2), (4) Date: Nov. 4, 2003

(87) PCT Pub. No.: WO02/095114
PCT Pub. Date: Nov. 28, 2002

(65) Prior Publication Data

US 2004/0144139 A1 Jul. 29, 2004

(30) Foreign Application Priority Data

May 25, 2001 (IT) ..... MI2001A1116

(51) Int. Cl.
*D06F 17/02* (2006.01)

(52) U.S. Cl. ..... 68/198; 68/189; 68/196; 68/5 R; 68/6; 68/7; 68/9; 68/10; 68/11

(58) Field of Classification Search ..... 68/189, 68/198, 196, 9–11, 5 R, 6, 7
See application file for complete search history.

(56) References Cited

U.S. PATENT DOCUMENTS

| | | | | |
|---|---|---|---|---|
| 1,327,662 | A * | 1/1920 | Dudley | 68/189 |
| 1,775,922 | A * | 9/1930 | Abbott, Jr. | 68/189 |
| 1,798,623 | A * | 3/1931 | Obermaier | 68/150 |
| 2,721,468 | A * | 10/1955 | Pole | 68/198 |
| 3,145,555 | A * | 8/1964 | Krantz | 68/189 |
| 3,695,827 | A * | 10/1972 | Byrd | 8/155.2 |
| 3,760,614 | A * | 9/1973 | Bergholtz | 68/189 |
| 4,079,603 | A * | 3/1978 | Bergholtz | 68/15 |
| 4,516,413 | A * | 5/1985 | Barriquand et al. | 68/5 C |
| 4,545,135 | A * | 10/1985 | Barriquand et al. | 34/58 |
| 5,323,629 | A * | 6/1994 | Aurich et al. | 68/27 |
| 6,405,568 | B1 * | 6/2002 | Bellini | 68/10 |

FOREIGN PATENT DOCUMENTS

| | | |
|---|---|---|
| EP | 0 060 163 | 9/1982 |
| WO | WO 99/16953 | 8/1999 |

* cited by examiner

*Primary Examiner*—Michael Barr
*Assistant Examiner*—Sarah E. Husband
(74) *Attorney, Agent, or Firm*—Hedman & Costigan; James V. Costigan

(57) ABSTRACT

Dying or bleaching apparatus for yarn wound on reels or similar packages, comprising a dying boiler (15) having an annular section suitable for receiving a single circular load of mobile reel holder shafts (13) which can be removed at the same time for the subsequent water draining and drying operations, operating with less liquid and also capable of being used with fractional capacities with a constant soaking ratio.

9 Claims, 8 Drawing Sheets

Figure 1:
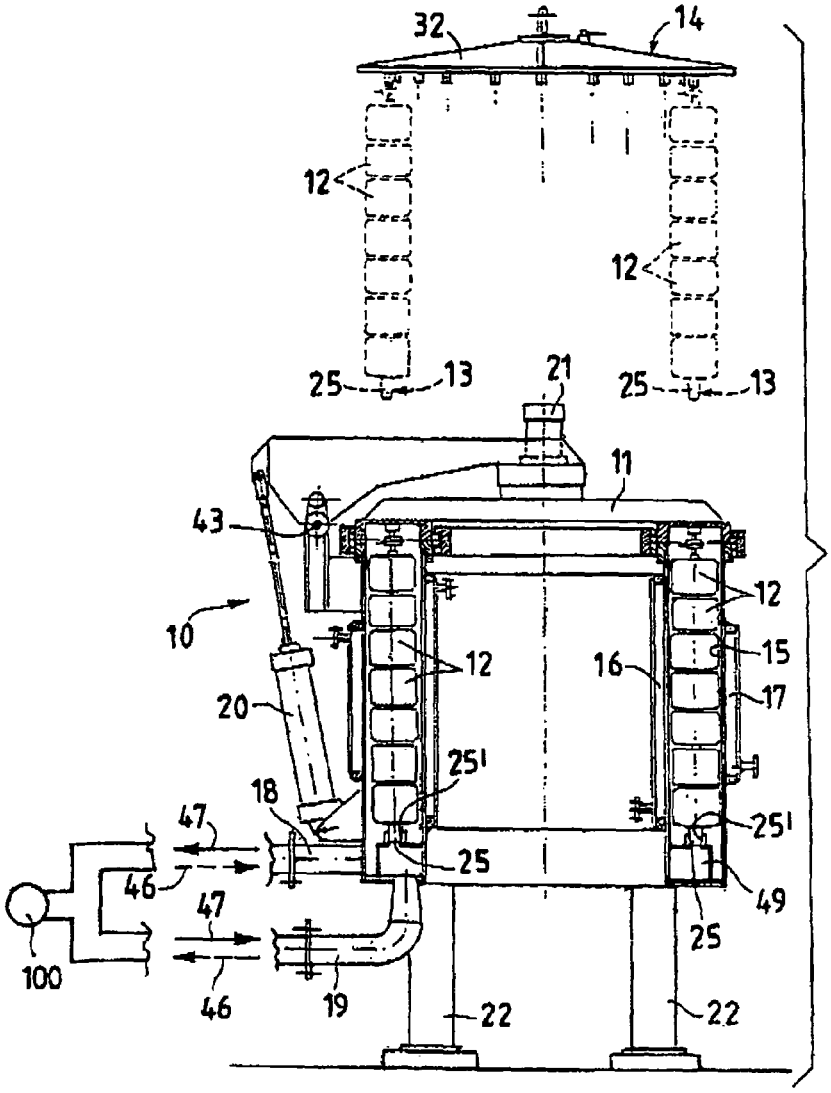

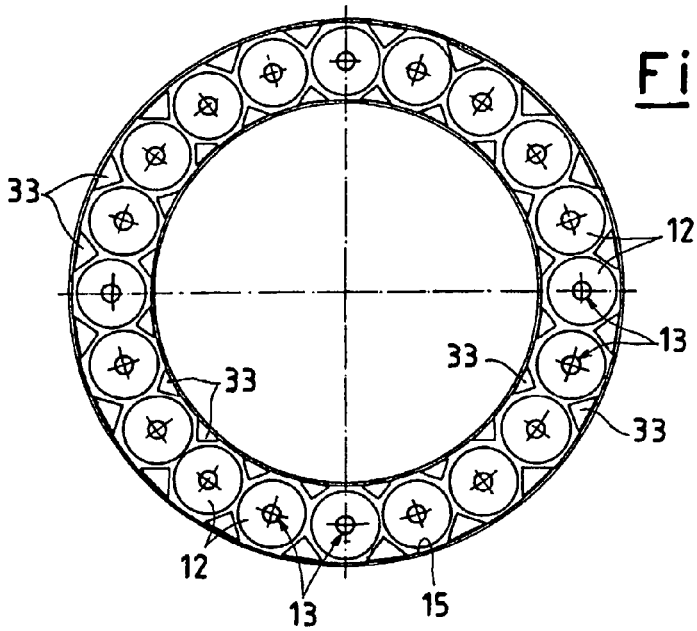
Fig.4
Fig.5a
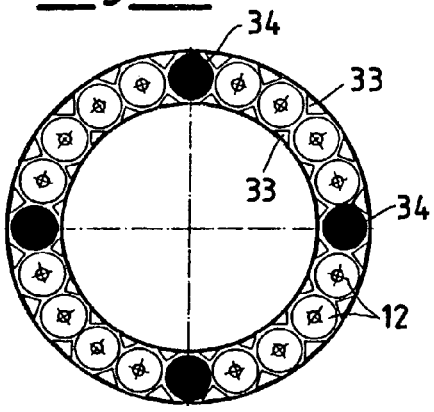
Fig.5b
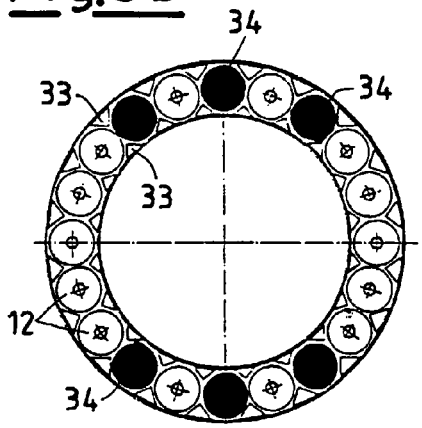
Fig.5c
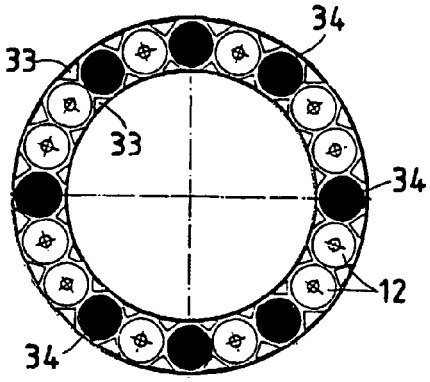
Fig.5d
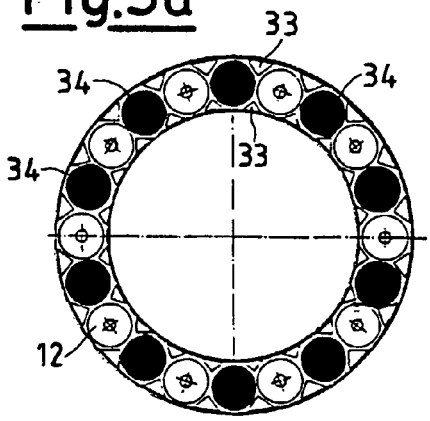

DYING OR BLEACHING APPARATUS FOR YARN WOUND ON REELS OR SIMILAR PACKAGES

The present invention refers to a dying or bleaching apparatus for yarn wound on reels or similar packages. Traditional dying or bleaching apparatuses for yarn wound on reels or similar packages are made of stainless steel resistant to corrosive chemicals, and operate at a high temperature and under static pressure.

Substantially, the apparatuses in question consist of a cylindrical treatment boiler with a convex base and cover, of which this cover can be locked with a closing device using superposed teeth or the like, which can be flipped over through a pneumatic cylinder. The boiler is equipped with a pump for the reversible circulation of the dying liquid and with a heat exchange group for heating or cooling the liquid.

The heat exchange group, by indirect steam, consists either of an inner coil, generally arranged on the base of the boiler, or of an outer heat exchanger arranged on the piping connecting the pump to the boiler. In particular, in the solution with the coil, the heating takes place by the passage of steam in it, whereas the cooling is obtained with the passage of cold water.

The apparatus is completed by various accessories, such as a small pump for the static pressure, an expansion tank outside of the bath which also functions as a recipient for the introduction of the dying ingredients, and command and control equipment which play no part in the present invention and which will therefore be ignored hereafter.

Inside the boiler the removable material holder can be arranged carrying a plurality of shafts upon which the reels to be treated are mounted.

These apparatuses work with a soaking ratio which varies from 1/10 to about 1/13, that is they use from 10 to 13 liters of water for every kg of material treated, with a variable number of water changes for each dying cycle.

The number of water changes in a treatment cycle of course varies according to the type of textile material to be treated and to the class of dyes used.

This number of water changes can be quantified from a minimum of two up to a maximum which can even exceed ten, of which most are with hot liquid. From this it is clear that in dying processes there is a large water and steam consumption.

The complete operative cycle foresees the load of reels slotted one on top of the other on the material holder shafts, the insertion of the material holder into the boiler, the dying treatment in the boiler, the removal of the material holder from the boiler, the removal of the reels from the shafts, the insertion of the reels in a centrifugal water draining machine, the water draining treatment for the maximum possible removal of water from the reels, the removal of the reels from the water draining machine, the loading of the reels onto the shafts of the trolley of the drier, the introduction of the trolley into the drier, the drying of the reels, the removal of the trolley with the final discharge of the treated and dried reels.

If one considers the problems regarding the environment, it can be clearly seen that the modern dying industry requires machinery which reduces all forms of atmospheric and environmental pollution. Then considering both the energy and workforce costs, ever more apparatuses are needed which reduce consumption and energy costs per production unit, and which allow a reduction, if not elimination, of the manipulations of yarn in some steps of the aforementioned productive cycle, simplifying it with a consequent reduction in the production costs.

Another requirement, which is urgently demanded by the market, should be added to the above, that being an ever more flexible use of these apparatuses, understood in the sense of being able to use them not just at full capacity but also, according to requirements, partly full, and this, of course, with a virtually constant soaking ratio.

The purpose of the present invention is that of realising a dying or bleaching apparatus for yarn, on reels or similar packages, which allows the manipulations to be carried out to be minimised as far as possible.

Another purpose of the present invention is that of realising a dying or bleaching apparatus for yarn wound on reels or similar packages, which uses a very short soaking ratio, reducing atmospheric and environmental pollution and energy costs accordingly.

Another purpose of the present invention is that of realising a dying or bleaching apparatus which allows a good flexibility of use, maintaining a constant soaking ratio as the load of material to be treated varies.

A further purpose of the present invention is that of realising a particularly simple and functional dying or bleaching apparatus at a contained cost.

These purposes according to the present invention are achieved by realising a dying or bleaching apparatus for yarn wound on reels or similar packages, as outlined in claim 1.

Further characteristics are foreseen in the dependent claims.

Figure 8:
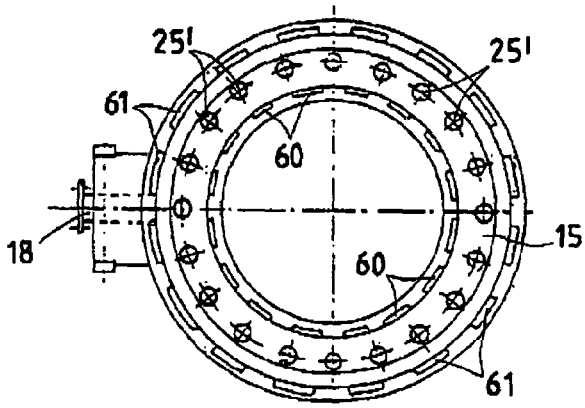
Figure 2:
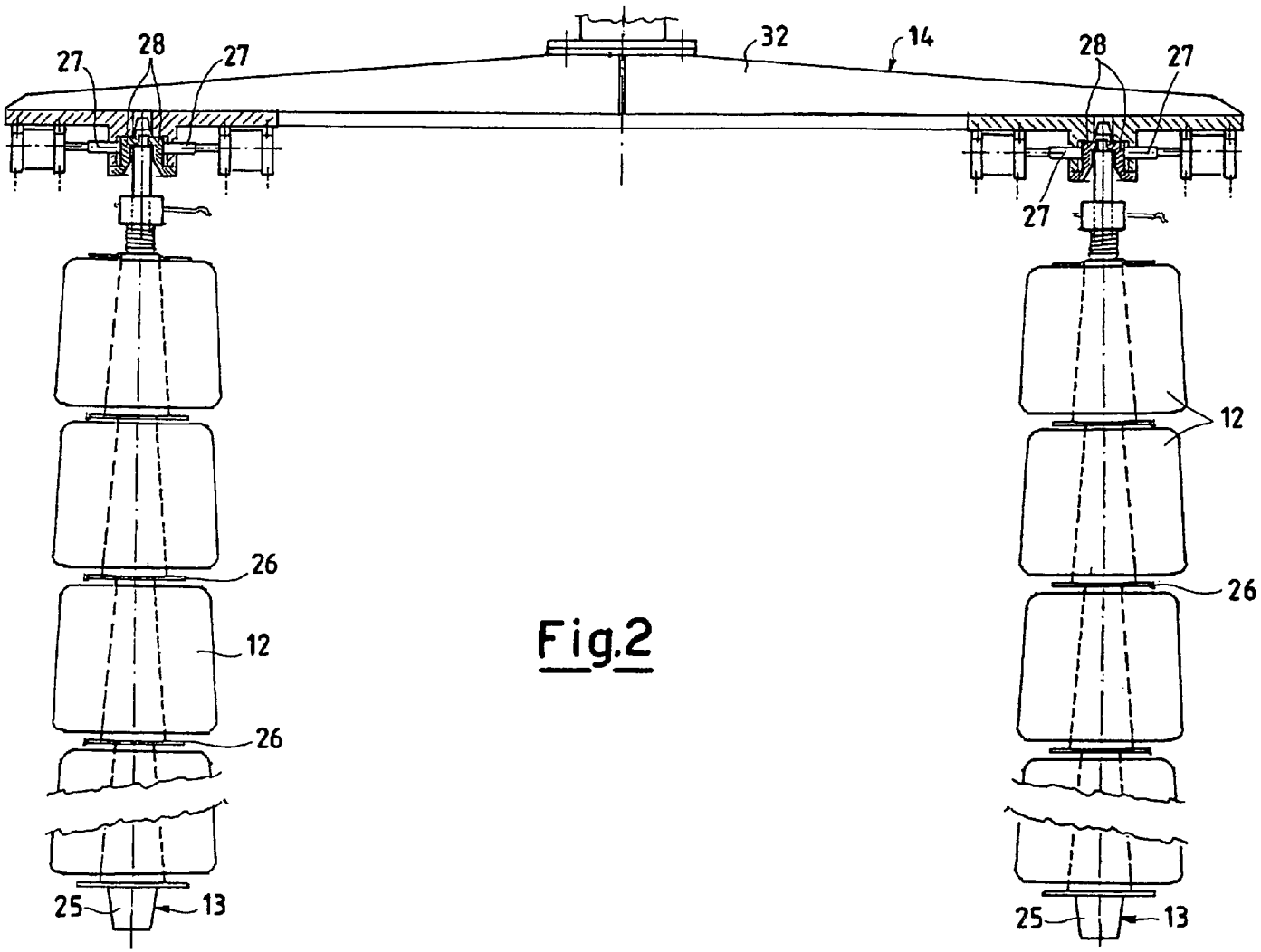
Figure 3A:
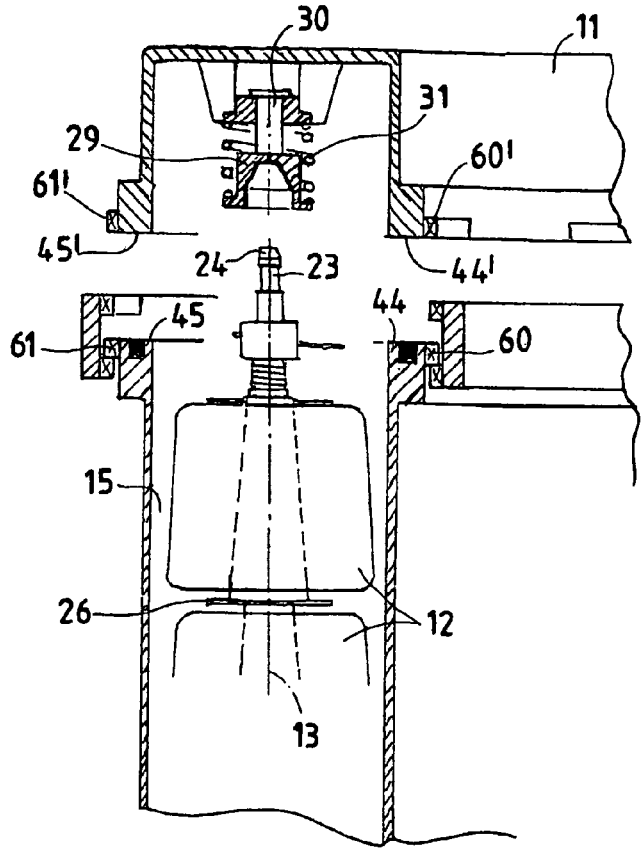
Figure 3B:
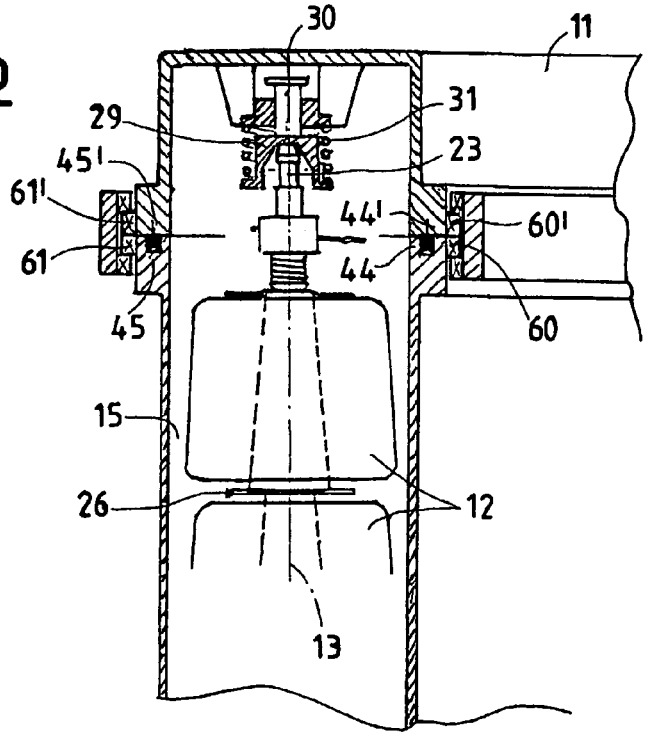
Figure 6:
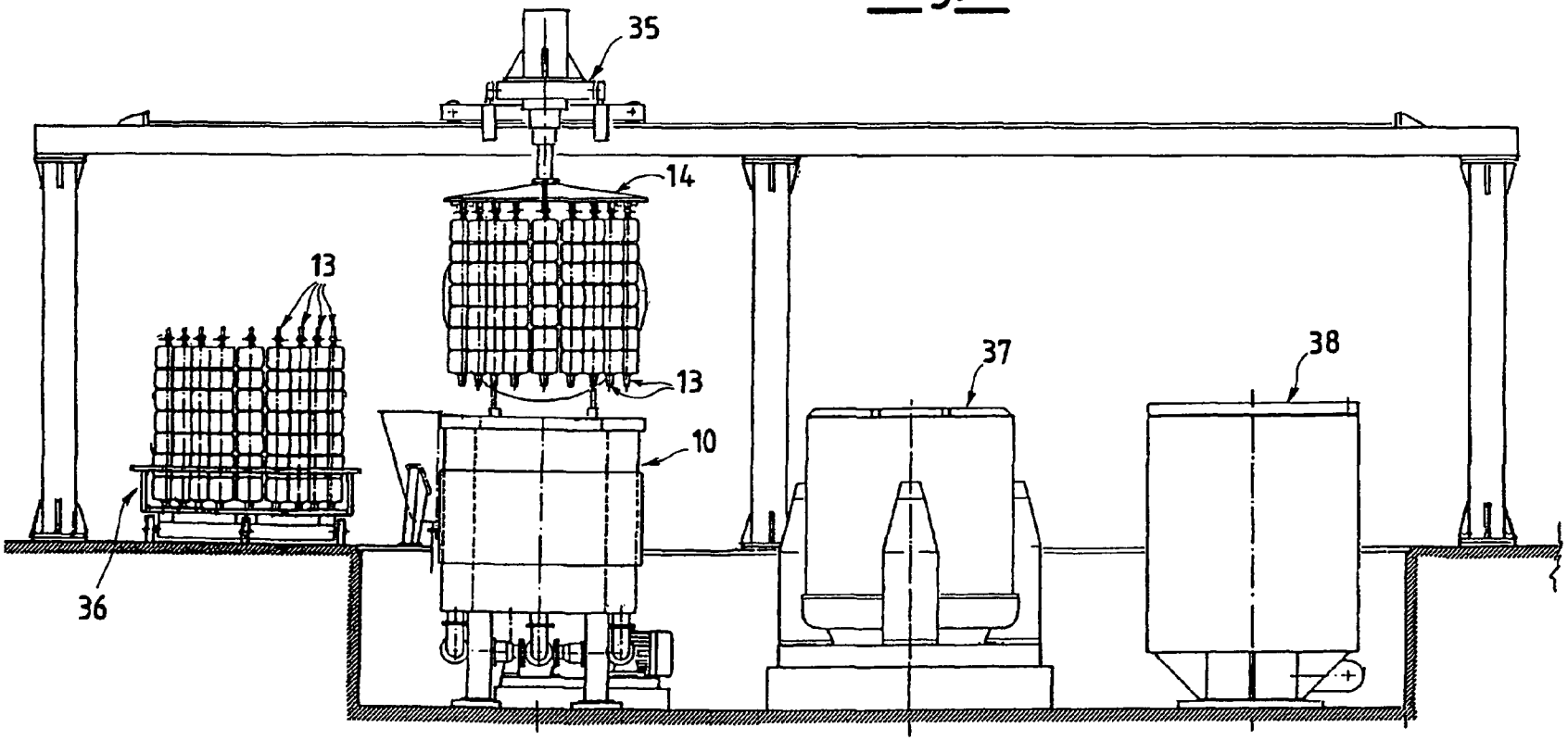
Figure 7A:
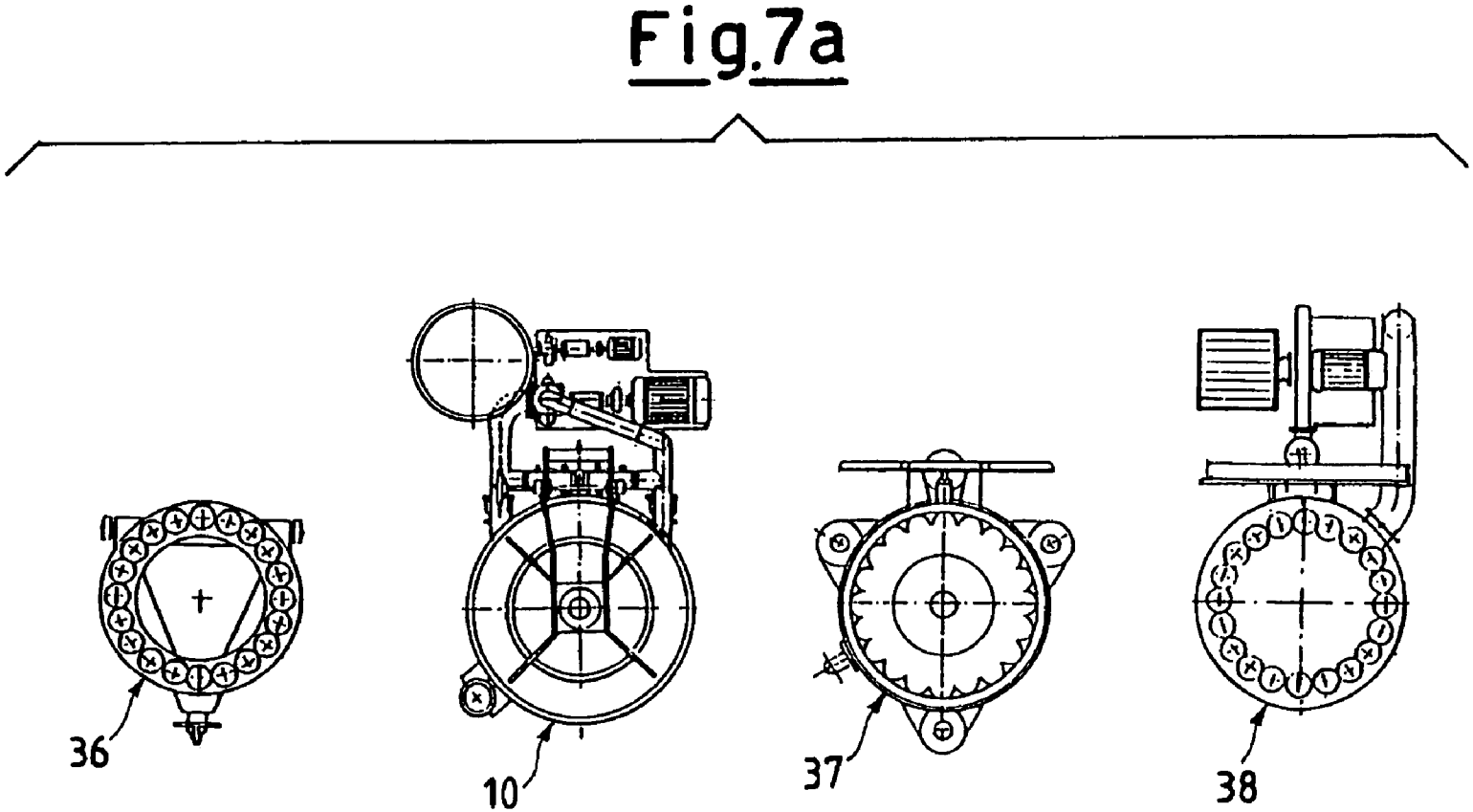
Figure 7B:
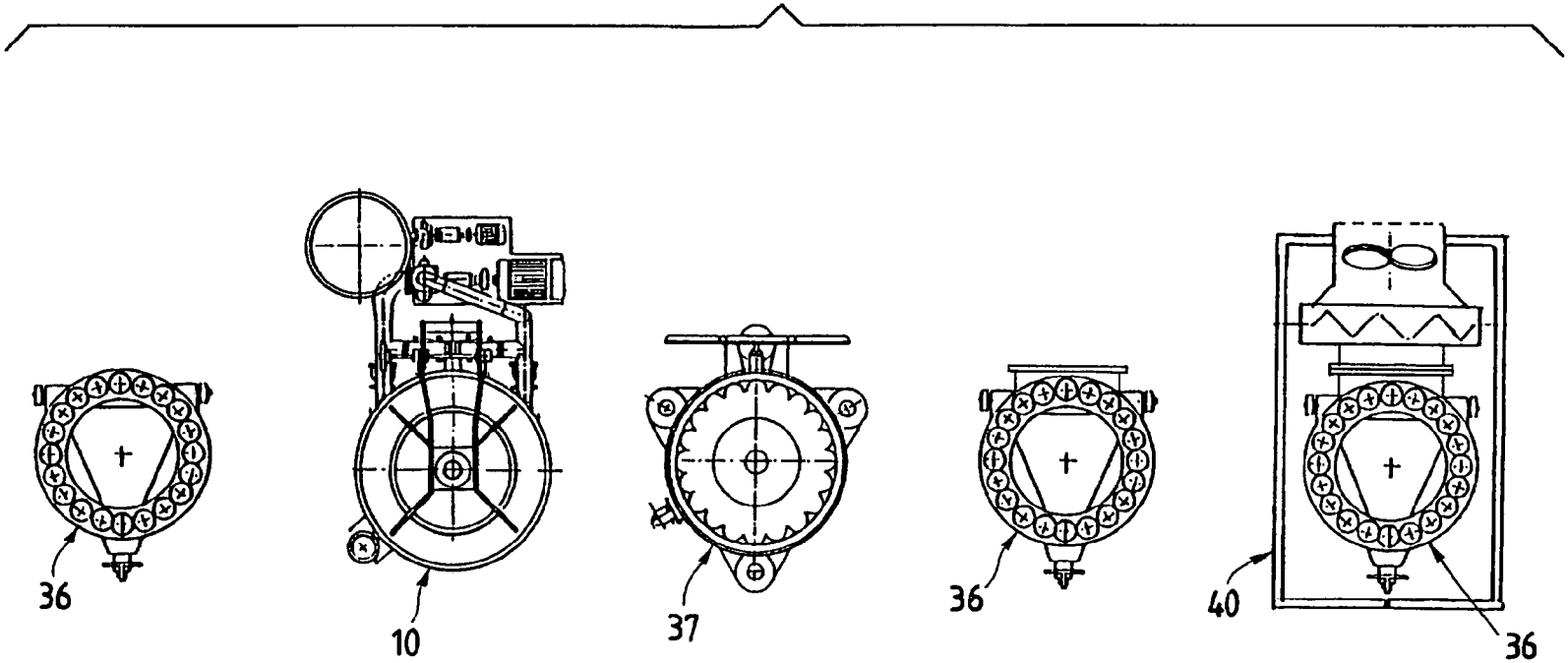
Figure 7C:
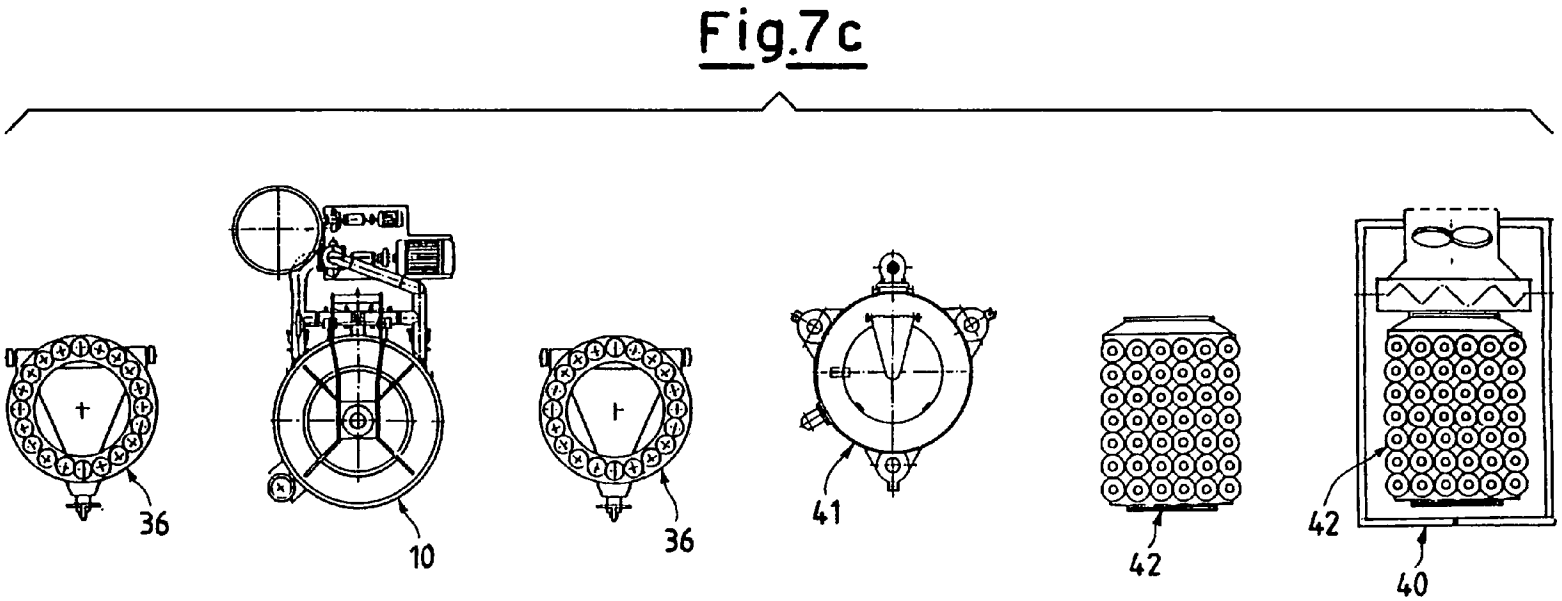

The characteristics and advantages of a dying or bleaching apparatus for yarn wound on reels or similar packages, according to the present invention shall become clearer from the following description, given as an example and not for limiting purpose, referring to the attached schematic drawings in which:

FIG. 1 is a side elevational section view of a boiler having an annular treatment section in closed configuration of a dying or bleaching apparatus for yarn wound on reels, according to the present invention, in which reel holder shafts have been inserted through a moving device for all of the reel holder shafts, shown above the boiler with a side view, where, for the sake of simplicity, just two shafts are represented with a broken line;

FIG. 2 shows an enlarged side elevational section view of a device for moving all of the reel holder shafts, carrying just two shafts for the sake of simplicity;

FIGS. 3*a* and 3*b* show an enlarged side elevational section view of a detail of a cover of a small boiler of the apparatus of FIG. 1, in a step prior to closing and in closed position, respectively;

FIG. 4 shows a plan view from above of the single boiler of the apparatus of FIG. 1 filled with reel holder shafts and wedge-shaped profiles;

FIGS. 5*a*, 5*b*, 5*c* and 5*d* show four plan views from above of the single boiler of the apparatus of FIG. 1 filled with four different loads of reel holder shafts and cylindrical liquid reduction buffer lungs;

FIG. 6 shows a front view of the dying apparatus of FIG. 1, inserted in an embodiment of a dying line, upstream of a centrifugal water-draining machine with hoists having a beehive section and of a drier with a chamber having a circular section;

FIGS. 7*a*, 7*b* and 7*c* show three different plan views from above of three productive embodiments of a dying line, with respective trolleys, specifically in FIG. 7*a* the line of FIG. 6 is schematised, in FIG. 7*b* a line with a traditional drier having a chamber with a rectangular section can be seen, and finally in FIG. 7*c* a line with a traditional water draining apparatus and a traditional drier is shown;

FIG. 8 shows a plan view from above of the single boiler in open configuration of the apparatus of FIG. 1, where two series of inner and outer teeth for clamping a cover to close the boiler and seats for the reel holder shafts can be seen.

Before anything else it must be said that only those parts of a dying apparatus which are essential for a complete understanding of the invention are illustrated in the drawings and shall be described hereafter, whereas all accessories which can be realised in a traditional manner which are well known in the prior art have been left out.

Moreover, reference shall always be made to a dying apparatus, but it is to be understood that it could also concern apparatuses for bleaching or for other treatments.

With reference to the figures, a dying apparatus, equipped with an annular section boiler, is shown wholly indicated with 10.

FIG. 1 represents a cylinder-shaped treatment boiler 15 with a vertical axis, having a circular crown section, with a base rested upon bearings 22, which is equipped with an inner heat exchange chamber 16 and with an outer heat exchange chamber 17. The boiler 15 is closed with a cover 11, pivoted on a pin 43, and actuated by a flip-over cylinder 20 and by a lowering cylinder 21 of the cover 11.

A device for circulating dying liquid, according to two opposite directions indicated by arrows 46 and 47, is foreseen consisting of an outer pump 100 connected to the boiler 15 with a lateral piping 18 and with a lower piping 19 which carries an annular collector 49.

Above the collector 49 inverted cone-shaped seats 25' are foreseen. Such seats host a conical lower end 25, which can be seen in FIG. 2, of reel holder shafts 13, on which reels 12 to be treated are slotted. In the case of FIG. 2 the reels 12 are wound on conical perforated supports and are separated by spacer disks 26. In the case of reels 12 wound on special cylindrical perforated supports the disks 26 can also be left out.

FIG. 2 shows a circular device 14 for moving all of the shafts 13 arranged around the circumference, comprising a structure 32 which carries attachments for locking all the shafts 13, each consisting of a pair of small pistons 27, or of other known systems, which push two pincers 28 in correspondence with a grooved upper end 23—which can be seen in FIGS. 3*a* and 3*b*—of the shaft 13.

FIGS. 3*a* and 3*b* show a detail of a lock of a cover 11 on a boiler 15, which takes place between an inner edge 44 and an outer edge 45 of an upper end of the boiler 15, and an inner edge 44' and an outer edge 45' of a lower end of the cover 11. On the cover 11 locking and centring devices are foreseen, one for each shaft 13, consisting of a pin 30, equipped with a spring 31, which terminates with a conical seat 29, to receive the shaft 13 which terminates on top with a countersink 24.

In FIG. 4 wedge-shaped profiles 33 for reducing the amount of dying liquid can be seen, whereas in FIGS. 5*a*, 5*b*, 5*c* and 5*d* cylindrical buffer lungs 34, also for reducing the dying liquid, are shown.

Said profiles 33 have a shape such as to occupy, inside the boiler 15, space which is not used by the reels 12 with the maximum outer diameter, which are slotted into the shafts 13. Thus most of the dead zones inside the boiler 15 are eliminated.

A buffer lung 34 has a cylindrical shape and occupies the same space as that of the shaft 13 loaded with reels 12 with a maximum outer diameter.

At an upper end, the buffer lung 34 is equipped with a grooved end and with a countersink (not shown but identical with respect to those of the shaft 13, which are respectively indicated with the reference numerals 23 and 24). In the same way, the buffer lung 34 is equipped, on the opposite side, with a conical end (not shown but identical with respect to the one of the shaft 13, which is indicated with the reference numeral 25). In this way a buffer lung 34 is interchangeable with a shaft 13.

FIG. 6 shows, under a crane 35, a dying line consisting of a trolley 36 which carries a series of shafts 13, arranged on a circumference, of a dying apparatus 10, of a centrifugal water draining machine with beehive hoists or perforated tubes 37 and of a drier with a chamber having a circular section 38.

In FIGS. 7*a*, 7*b* and 7*c* other embodiments of the dying line are shown, in which one should note, in addition with respect to FIG. 6, a traditional drier with a chamber having a rectangular section 40, a traditional water draining machine 41, and a rectangular trolley 42 which carries a series of fixed axes.

FIG. 8 illustrates a double mechanical and airtight closing system of the inner 44 and outer 45 upper edges of the boiler 15 on the inner 44' and outer 45' lower edges of the cover 11, for such a purpose, as seen in FIGS. 3*a* and 3*b*, the boiler 15 is equipped with series of inner 60 and outer 61 inner upper teeth, and the cover 11 is equipped with inner 60' and outer 61' inner lower teeth, which, when closed, superpose the inner 60 and outer 61 inner teeth.

The reels 12 to be dyed, wound on conical perforated supports, are slotted into the shafts 13, separated by disks 26, and these shafts 13 are positioned onto the trolley 36 to then, all together, through the device 14, be loaded into the dying apparatus 10.

In particular, said shafts 13 are positioned in the boiler 15, which, as can be seen in FIGS. 1 and 4, is sized so that its circular crown-shaped section has a thickness slightly greater than the maximum diameter of the reels 12.

The boiler 15 has, formed internally towards the bottom, on a circumference which passes through the centre of the circular crown of the boiler 15, a series of seats 25'. Said seats 25' are sized to receive the conical lower ends 25 of the shafts 13.

Advantageously, a series of shafts 13, in the example in FIG. 4 there are twenty, can be positioned simultaneously, to fill all the circular crown, by using the moving device 14.

Such a device 14 has a circular structure 32 which comprises a series of pairs, one for each shaft 13, of small pistons 27, or other known means, arranged along the same circumference as the central one of the circular crown of the boiler 15. The small pistons 27 can be actuated to clamp or release the grooved upper end 23 of the shafts 13 themselves, through the pincers 28, mounted at the end of the small pistons 27, which can engage in the grooved ends 23.

As can be seen in FIG. 6, the device 14 clamps all of the shafts 13 arranged around the circumference for example on the trolley 36, on the same circumference as the central one of the circular crown of the boiler 15, and lowers them from above into the dying apparatus through the crane 35.

Once the shafts 13 are inserted in the seats 25', the cover 11 is closed with two distinct movements, actuated by the two cylinders 20 and 21.

The cylinder 20 actuates a flip-over of the cover 11 about the pin 43, into the position indicated in FIG. 3*a*. This takes place thanks to an arm, carrying at one end the cover 11, which is pivoted, in an outer zone near to an outer edge 45 of the boiler 15, through the pin 43, and which is connected at the other end to the cylinder 20, in turn hinged on an outer surface of the boiler 15.

Then the cylinder 21 carries out the lowering of the cover 11 and in this step the locking of the shafts 13 in their positions also takes place. This is carried out through devices formed by pins 30, which terminate with conical seats 29: in locking, which can be seen in FIG. 3*b*, said conical seats 29 are forced by the compressed springs 31 towards the upper countersinks 24 of the shafts 13, thus obtaining the locking and also the centring, thanks to their conical shape.

The mechanical and airtight locking of the boiler 15 is carried out by locking the cover 11 with the double system of inner 60 and 60' and outer 61 and 61' superposed teeth.

As can be clearly seen in FIG. 4, the inside of the boiler 15, equipped with wedge-shaped profiles 33, has practically no dead zones when the shafts 13 are arranged in it.

Alternatively, partial loads of the dying apparatus 10 are possible, using the cylindrical buffer lungs 34, which fill the space which would be occupied by the shafts 13 loaded with reels 12 having the maximum outer diameter. In FIGS. 5*a*, 5*b*, 5*c* and 5*d* four different partially loaded situations can be seen.

After the quoted closing of the covers 11, the boiler 15 is filled with the dying liquid.

Through the outer pump a circulation of the liquid is promoted, also with the possibility of inverting the direction of the flow. According to the direction indicated by the arrows 47, the liquid circulates from the piping 19, through the annular collector 49 and the reels 12, up to the piping 18. By inverting the flow, one gets the circulation indicated by the arrows 46, from the piping 18 to the piping 19.

The dying liquid is heated through the inner heat exchange chamber 16. Vice-versa, the cooling of the liquid takes place through the outer heat exchange chamber 17.

With the dying apparatus 10 it is also possible to rationalise production. Regarding this, in FIG. 6 and FIG. 7*a* a dying line is represented which foresees a trolley 36 where the shafts 13 are circumferentially arranged with the reels 12 to be treated. These shafts 13 are picked up by the crane 35 which lowers them, through the moving device 14, into the dying apparatus 10. After the cycle in the apparatus 10, the series of shafts 13 is picked up by the moving device 14 and is lowered into the centrifugal water-draining machine 37, which can be with a beehive hoist or with perforated tubes, of a suitable size to host the circumferential series of shafts 13. At the end of this step, the moving device 14 picks up the series of shafts 13 and lowers them into the drier 38, which has a chamber with a circular section of a suitable size for hosting the circumferential series of shafts 13, where the process is completed.

Alternatively, in FIG. 7*b* the production line includes, with respect to FIG. 7*a*, instead of the drier with a chamber having a circular section 38, a traditional drier 40 with a chamber having a rectangular section, for which reason, at the exit from the centrifugal water draining apparatus 37, the circumferential series of shafts 13 is picked up by the moving device 14 and is rested on a trolley 36, which is then taken into the drier 40.

In another alternative, in FIG. 7*c* the production line includes, with respect to FIG. 7*a*, a traditional water draining machine 41 and a traditional drier 40 with a chamber having a rectangular section, for which reason, at the exit of the dying apparatus 10, the circumferential series of shafts 13 is picked up by the moving device 14 and is rested upon a trolley 36. From the trolley 36 the individual reels 12 are withdrawn from the shafts 13 and are positioned, manually or mechanically, in the traditional water-draining machine 41. At the end of the water-draining step the individual reels 12 are picked up and arranged, manually or mechanically, on a trolley 42, which is then taken into the traditional drier 40 with a chamber having a rectangular section, to conclude the treatment process.

It should be noted that the engineering solution realised in FIG. 7*a* is of course the optimal one, because it reduces the manipulations of the reels 12 in the production cycle to the minimum.

The advantage which characterises this particular embodiment of the dying apparatus, with a boiler having an annular section, is that of receiving the reels to be dyed on individual removable reel holder shafts, arranged on a single circumference, which can all be removed simultaneously through a circular device with pneumatic pincers, or another known means, and which can therefore be positioned, without intermediate manipulations, firstly in the centrifugal water draining machine with a beehive hoist or perforated tubes and then in the drier with a circular chamber.

For this last drying operation, it is very important that the residual humidity of the yarn after the water draining is uniform in all the reels and this, in the case of the apparatus of the present invention, is guaranteed by the fact that the reel holder shafts are arranged on a single circumference, a thing which is not possible in traditional apparatuses.

A further advantage is the rationalisation of production, since the manual transfer operations of the reels from the dying apparatus to the water draining apparatus, and from here to the drier are eliminated.

In practice, therefore, the entire batch is dyed, centrifuged and dried without intermediate manipulations of the reels.

Regarding this, the arrangement of the reel holder shafts on a single circumference simplifies enormously the possible automation with robots of the initial loading operation and of the final unloading of the individual reels from the shafts.

Moreover, the adoption, in the dying apparatus, of reducer buffer lungs instead of the same number of reel holder shafts allows the treatment of partial loads still with a constant soaking ratio: the operative flexibility is therefore at its maximum.

Finally, to treat large batches, apparatuses constructed with a modular structure can be realised, combining or twinning many dying apparatuses according to the present invention.

Moreover, the dying apparatus object of the present invention, still keeping the essential special characteristics of traditional apparatuses, that is working totally full and with inversion of the direction of the circulation liquid, not only substantially reduces its soaking ratio, but furthermore improves its dying capability.

This has been made possible thanks to the innovative shape of the dying boiler having an annular section, possibly completed with wedge-shaped reducer profiles, which not only has practically no dead zones, but also has allowed the one usually created by the heating coil arranged on the base of traditional apparatuses to be eliminated.

In fact, this new boiler has, instead of the inner coil, two heat exchange chambers, consisting of two annular interspaces outside of the body of the boiler, one used to heat and the other used to cool the dying liquid, which, moreover, allow a greater cleanliness and safety of management of the apparatus. Moreover, thanks to the large heat exchange surface available, there is an excellent heating and cooling speed and efficiency.

The reduction of the soaking ratio leads to the simultaneous reduction in water, energy, steam and chemical product consumption and of the atmospheric and environment polluting discharges.

Moreover, the treatment times are reduced since, with the same flow rate of the pump and with the same heat exchange surface with respect to traditional apparatuses, due to the substantial reduction in the bath volume, increase its cycles per minute as well as its temperature rise gradient, and thus in theory, and compatibly with the characteristic lifetime curves of dyes, the treatment times reduce. Moreover, the increase in the cycles per minute also involves an improvement of the dying capabilities.

The dying apparatus thus conceived is susceptible to modifications and variants, all covered by the invention; moreover, all of the details can be replaced by technically equivalent elements. In practice, the materials used, as well as the sizes, can be whatever according to the technical requirements.

The invention claimed is:

1. Dying or bleaching apparatus for yarn wound on reels or similar packages, with a reduced soaking ratio, comprising a treatment boiler (15) closed on a base and equipped with a removable closing cover (11), said boiler (15) being equipped with entry and/or exit pipings (18, 19) for a treatment liquid connected to a circulation pump (100) and with a heat exchange group comprising two heat exchange chambers (16, 17), in said boiler (15) with a vertical axis being arranged a plurality of support shafts (13) with a parallel axis, upon each of which reels of yarn or similar packages (12) are slotted one on top of the other, said boiler (15) being externally cylinder-shaped and having an annular section and said support shafts (13) being removable and being each arranged circumferentially in housings (29, 25') formed near to said cover (11) and to said base, respectively, in which the radial thickness of said annular section is slightly greater than the maximum diameter of each of said reels or similar packages (12), said cover (11) being equipped with an inner circular edge (44") and with an outer circular edge (45') which, in the closing operation, abut against an inner edge (44) and an outer edge (45), respectively, of the boiler (15) said two heat exchange chambers (16, 17) consisting of two annular interspaces disposed outside of the annular body of said boiler (15) and forming an inner heat exchange chamber (16) with a circular crown-shaped section, which carries out the heat exchange with liquid through part of the inner cylindrical surface of the boiler (15), and an outer heat exchange chamber (17) with a circular crown-shaped section, which carries out the heat exchange with the liquid through part of the outer cylindrical surface of the boiler (15).

2. Apparatus according to claim 1, characterized in that said cover (11) is actuated by a flip-over cylinder (20, 43), and by a cylinder (21) mounted on the outside on its central axis, which lowers the cover (11) towards the boiler (15) until it closes it and at the same time locking the support shafts (13), through a compression of the springs (31).

3. Apparatus according to claim 1, characterized in that, for the mechanical and airtight closing of the boiler (15) with said cover (11), a double mechanical and airtight closing system of inner (44) and outer (45) upper edges, of the boiler (15) on inner (44') and outer (45') lower edges of the cover (11), respectively equipped, the boiler 15 being equipped with series of inner (60) and outer (61) upper teeth, and the cover (11) being equipped with series of inner (60') and outer (61') lower teeth, which, in said closing, superpose the inner (60) and outer (61) teeth.

4. Apparatus according to claim 1, characterized in that said housing (25'29) consists of a series of conical seats (25'), formed on the inner base of the boiler (15), and arranged on a single circumference which passes through the centre of the thickness of the circular crown of the boiler (15), and of a corresponding series of conical seats (29), formed on the cover (11), which, when the cover (11) is closed on the boiler (15), are coaxial with the vertical axes which pass through the centre of each conical seat (25') formed on the base of the boiler (15), and which are situated on a surface which faces towards the inside of the boiler (15), said apparatus further characterized in that said support shafts (13) are equipped below with conical ends (25), suitable for a removable housing in said conical seats (25'), said apparatus further characterized in that said conical seats (29) on the cover (11) are each mounted on a pin (30) equipped with a compensation spring (31), so as to block, in the act of closing the cover (11) on the boiler (15), the support shaft (13) in the conical seat (25') formed on the base of the boiler (15), through a countersink (24) realized at the upper end of the shaft (13).

5. Apparatus according to claim 4, characterized in that in some of said housings (25', 29) cylindrical buffer lungs (34) are arranged which have below a conical end (25), suitable for the conical seat (25') of the boiler (15), and above a countersink (24), suitable for the conical seat (29) of the cover (11), and which have a cylinder-shaped body with a diameter equal to the maximum diameter of each of said reels or similar confections (12), and have a height at least equal to the sum of the heights of the maximum number of reels or similar confections (12) which are slotted on a support shaft (13), said cylindrical buffer lungs (34) being interchangeable with said shaft (13).

6. Apparatus according to claim 1, in that in the boiler (15), at least partially in a space not occupied by the support shafts (13) which carry the reels (12) and by cylindrical buffer lungs (34), wedge-shaped profiles (33) are inserted, to further reduce the treatment liquid.

7. Apparatus according to claim 1, characterized in that said support shafts (13) and said cylindrical buffer lungs (34) have at the top a grooved end (23) which is suitable for being clamped through devices equipped with pincers (28), moved by small pistons (27).

8. Apparatus according to claim 1, characterized in that said inner chamber (16) carries out a heating of the liquid through indirect steam or another thermal fluid.

9. Apparatus according to claim 1, characterized in that said outer chamber (17) carries out a cooling of the liquid through cold water.

* * * * *